US011543215B2

(12) United States Patent
Mazej et al.

(10) Patent No.: US 11,543,215 B2
(45) Date of Patent: Jan. 3, 2023

(54) BULLET-RESISTANT ROLLER DOOR

(71) Applicant: EFAFLEX INŽENIRING d.o.o. Ljubljana, Ljubljana (SI)

(72) Inventors: Andrej Mazej, Vodice (SI); Jurij Letonje, Mengeš (SI); Maja Kobe, Novo mesto (SI)

(73) Assignee: EFAFLEX INŽENIRING d.o.o. Ljubljana, Ljubljana (SI)

( * ) Notice: Subject to any disclaimer, the term of this patent is extended or adjusted under 35 U.S.C. 154(b) by 903 days.

(21) Appl. No.: 16/334,570

(22) PCT Filed: Sep. 21, 2017

(86) PCT No.: PCT/EP2017/073939
§ 371 (c)(1),
(2) Date: Mar. 19, 2019

(87) PCT Pub. No.: WO2018/055051
PCT Pub. Date: Mar. 29, 2018

(65) Prior Publication Data

US 2021/0293515 A1 Sep. 23, 2021

(30) Foreign Application Priority Data

Sep. 22, 2016 (DE) ..... 10 2016 117 884.5

(51) Int. Cl.
*F41H 5/22* (2006.01)
*E06B 9/15* (2006.01)
*E06B 9/68* (2006.01)

(52) U.S. Cl.
CPC ..... *F41H 5/226* (2013.01); *E06B 9/15* (2013.01); *E06B 9/68* (2013.01); *E06B 2009/1505* (2013.01); *E06B 2009/1566* (2013.01)

(58) Field of Classification Search
CPC ... F41H 5/226; E06B 5/10; E06B 9/15; E06B 2009/1516; E06B 2009/1533; E06B 2009/1583; E06B 2009/1594; E06B 9/02
See application file for complete search history.

(56) References Cited

U.S. PATENT DOCUMENTS

| | | | | |
|---|---|---|---|---|
| 9,746,289 | B2 * | 8/2017 | Hahn | F41H 5/06 |
| 2007/0193701 | A1 | 8/2007 | Petrick et al. | |
| 2016/0230444 | A1 * | 8/2016 | Hahn | F41H 5/24 |

FOREIGN PATENT DOCUMENTS

| | | | |
|---|---|---|---|
| DE | 33 02 571 | A1 | 7/1984 |
| DE | 3325239 | A1 | 1/1985 |

(Continued)

*Primary Examiner* — Jonathan C Weber
(74) *Attorney, Agent, or Firm* — McGlew and Tuttle, P.C.

(57) ABSTRACT

A bulletproof roller door (1) has a door leaf (2) includes bendably connected door leaf elements (21) and defines a door leaf plane in roller door closed state, the door leaf being moveable between an open position and a closed position via a drive (5). The door leaf elements have cavities (25) with an antiballistic insert (26) insertable therein. The inserts of adjacent door leaf elements overlap in the closed state of the roller door (1). At least one antiballistic defense strip (30, 31) is set at an angle in relation to the insert and covers a gap between the inserts of adjacent door leaf elements in the closed state and is arranged in the cavity of the door leaf element. It is thus achieved that the roller door (1) possess high-speed properties, has a lowest weight possible, and also offers protection against ballistic effects.

14 Claims, 9 Drawing Sheets

(56) References Cited

FOREIGN PATENT DOCUMENTS

| | | | | |
|---|---|---|---|---|
| DE | 34 02 532 | A1 | 8/1985 | |
| DE | 37 43 628 | A1 | 8/1988 | |
| DE | 297 23 056 | U1 | 3/1998 | |
| DE | 202 15 261 | U1 | 1/2003 | |
| ES | 2463942 | A1 * | 5/2014 | ..... E06B 9/15 |
| JP | 2009203607 | A | 9/2009 | |
| WO | 03/052229 | A1 | 6/2003 | |

* cited by examiner

BULLET-RESISTANT ROLLER DOOR

CROSS REFERENCE TO RELATED APPLICATIONS

This application is a United States National Phase Application of International Application PCT/EP2017/073939, filed Sep. 21, 2017, and claims the benefit of priority under 35 U.S.C. § 119 of German Application 10 2016 117 884.5, filed Sep. 22, 2016, the entire contents of which are incorporated herein by reference.

TECHNICAL FIELD

The present invention pertains to a bulletproof roller door with a door leaf comprising door leaf elements connected to one another in a bendable manner via hinges, such as slats or sections, which door leaf defines a door leaf plane in the closed state of the roller door, wherein the door leaf can be moved to and fro between an open position and a closed position by means of a drive, wherein the door leaf elements have in the cross section respective cavities, into which an antiballistic insert is inserted such that the inserts of adjacent door leaf elements overlap in the door leaf plane in the closed state of the roller door, so that the door leaf possesses antiballistic properties over the entire door leaf plane in the closed state, wherein the insert has a plate-like (plate-shaped) configuration, wherein the insert is oriented obliquely in relation to the door leaf plane in the cavity of the door leaf element, and wherein the door leaf elements overlap each other in the area of the joints of the door leaf in a step-like manner (step-shaped), so that the respective insert following in the door leaf plane in the closed position extends over the insert located adjacent thereto in the closed position on the outer side of the door, forming a gap.

TECHNICAL BACKGROUND

Roller doors are used to separate different areas in space. They frequently separate an interior from the environment and thereby protect the inner area from external effects, such as temperatures, sun exposure or weather conditions, such as wind or rain. External effects may, however, also arise from violent effects on the roller door, such as ballistic effects. To make it possible to offer protection in hazardous situations, it is, moreover, necessary to be able to move the door leaf rapidly between the opened and closed states.

However, materials and constructions that could offer sufficient protection against ballistic effects are, in general, in conflict with the high-speed property of a roller door, because they considerably increase the weight of the door leaf.

There are difficulties, in particular, concerning the configuration of the connection points between individual slats of the door leaf. The individual slats must be configured as being movable relative to one another at these points, because the door leaf can only be deflected or rolled up into the opened state due to an articulated connection of the slats. The connections between the slats have hitherto often been brought about by means of elastic rubber profiles. However, such rubber profiles cannot offer any protection in respect to ballistic effects on the roller door.

An example of a storm and safety door is disclosed by US 2007/0193701 A1. The roller door described there contains a plurality of slats connected to one another. To offer a corresponding resistance, the slats are made of steel and they overlap one another. Sufficient strength of the slats is guaranteed by holding elements being additionally provided on both sides of a slat.

To further increase the resistance of the roller door, US 2007/0193701 A1 discloses inserts, which can be inserted into the cavities of the slats. These inserts have a solid profile and are held in the slats by the holding elements.

The drawback of the roller door disclosed in US 2007/0193701 A1 is, however, the weight of the roller door. An insert, which fills the entire volume of the slat, is provided here in order to ensure bulletproof properties. The overall weight of the roller door increases considerably as a result, as a consequence of which a high-speed property of the roller door can only be achieved with a great effort. The high dynamic stress resulting from the heavy own weight has an adverse effect on the entire construction of the roller door even if the drive is dimensioned as a sufficiently large drive, so that the service life of the roller door decreases greatly. In addition, the problem arises precisely in case of wide door constructions of, e.g., 8 m or more that the door leaf will sag based on the considerable own weight in the open state of the roller door.

Further, DE 34 02 532 A1 discloses a hollow section roller shutter slat for security roller shutters. This hollow section roller shutter slat is provided at least partially with a filling consisting of a textile composite made of fibers having high tensile strength and is shaped such that the filling areas of adjacent roller shutter slats overlap in the roller shutter.

Similarly, DE 37 43 628 A1 discloses a door or a roller shutter comprising partially mutually overlapping hollow sections. This door or this roller shutter is provided with an insert comprising a plurality of layers of a fabric or a mesh consisting especially of aramid for protection against projectiles, explosions or the like. The longitudinal edges of the inserts of adjacent hollow sections of a roller shutter overlap one another and are stabilized against fraying.

Even though the aforementioned documents offer an approach to solving the problem of keeping the weight of roller shutters or the like low by the use of inserts that consist of fabric layers, these constructions do not offer sufficient protection against ballistic effects. In particular, the overlapping areas of the individual inserts are weak points, which can be overcome in case of a targeted attack and are thus unable to guarantee sufficient protection of the interior.

SUMMARY

A basic object of the present invention is therefore to configure a roller door such that not only does this possess high-speed properties and has the lowest possible weight for this, but it also offers protection against ballistic effects at the same time.

This object is accomplished by a roller door having at least one antiballistic defense strip, which is positioned at an angle in relation to the insert and covers the gap between the inserts of adjacent door leaf elements in the closed state of the roller door, being, furthermore, arranged in the cavity of the door leaf element.

The antiballistic property of the roller door is achieved by the insertion of a plate-shaped (plate-like) insert as well as of at least one defense strip. Due to the special configuration of the door leaf element, the antiballistic property of the entire roller door can be achieved due to added parts, which can be manufactured in a very simple manner, namely, the insert and the defense strip. The manufacture of this insert and of the at least one defense strip in the form of a plate does not require any complicated processes of adaptation to the shape of the door leaf element, nor other shaping steps, such as bending or deep-drawing of the material. The original property of the material can thus be fully preserved and the antiballistic property can be ensured.

In addition, a very lightweight construction of the door leaf element is achieved due to the use of a plate-shaped insert. Since no solid profile, i.e., complete filling of the door leaf element, is provided, unlike in the state of the art, each individual door leaf element can be made antiballistic with the use of a small amount of additional material and the entire door leaf can thus be configured as a lightweight construction. A combination of the antiballistic property of the door leaf with the high-speed property of the roller door is possible due to this construction.

The security of the roller door, i.e., the capability of defense against ballistic attacks, is increased due to at least one defense strip bent in relation to the insert of a door leaf element being additionally formed. The weak point between the inserts, which is shown in the state of the art, is eliminated by the defense strip. Projectiles impacting obliquely in relation to the door leaf plane and especially fragments impacting at a small angle in relation to the door leaf plane are prevented by the defense strip from penetrating the interior being protected by the roller door.

In particular, the gap present between two inserts can be covered by the defense strips. This gap is formed between the inserts in the overlapping area of two adjacent door leaf elements. It defines a distance between the inserts at right angles to the door leaf planes, which distance extends over the entire width of the door leaf. The gap is present between an upper end of an insert and a lower insert end of the next insert in the closed state of the roller door. The shape of this gap changes, moreover, during the opening and closing operations when the position of the individual door leaf elements in relation to one another changes. Due to the at least one defense strip according to the present invention, no projectile or fragment can enter the interior through this gap, either.

Since, furthermore, the door leaf elements overlap each other in the area of hinges of the door leaf in a step-like manner (stepped), the respective insert following in the closing direction in the door leaf plane can extend over the insert located adjacent in the closing direction on the outer side of the door. It is ensured hereby that the door leaf can easily be deflected during the opening. Arrangement of the overlap as close to the center of rotation as possible minimizes the necessary space requirement during the deflection around the respective hinge, because the part of the door leaf element moving out during the deflection can thus be kept small. The space that must be kept available for the deflection of the door leaf can thus be small, as a result of which the roller door can be installed in many different areas. Due to an overlap of adjacent inserts, the door leaf additionally offers protection against weather-related effects. Rain, hailstones and the like are deflected on the outer side on the door leaf without being able to flow into the door leaf.

In addition, the plate-like shape (plate shape) makes possible the easy insertion of the insert into the door leaf element. As a result, the insert can easily be replaced and the antiballistic property of the roller door can thus be changed as needed. For example, replacement of an insert of bulletproofness class FB2 according to DIN EN 1522 with class FB4 according to DIN EN 1522 is conceivable here. The roller door could thus be made more secure, i.e., according to a higher bulletproofing class, during more turbulent times, whereas an antiballistic insert of a lower security class can be used under normal conditions.

The plate-like configuration (plate configuration) of the antiballistic insert offers advantages especially in conjunction with the oblique arrangement thereof. Lateral inserts are provided in the state of the art to achieve the stability of a door leaf element. Thus, additional constructive measures are necessary here in addition to the inserts for achieving the antiballistic property in order to make it possible to guarantee sufficient stability of the door leaf.

By contrast, both properties are obtained at the same time by the oblique positioning according to the present invention of the plate-shaped insert. The oblique positioning of the insert, which at the same time possesses the antiballistic property, reinforces the door leaf element, as a result of which the flexural strength of the door leaf element increases.

Due to such an increase in the flexural rigidity of the individual door leaf elements, the door leaf can thus be made, as a whole, wider, i.e., it can have larger dimensions. Sagging of the door leaf in the door lintel area due to the own weight can thus be minimized. The door leaf element can thus be held not only easily but also in a surprisingly simple manner in terms of construction. Not only is it possible due to this configuration of the door leaf element to increase the flexural rigidity, but a lightweight door leaf with antiballistic properties and thus a bulletproof, high-speed roller door can also be obtained at the same time.

Even though DE 202 15 261 U1 discloses a bulletproof double-armored roller door, in which the door leaf consists of slats, into which an obliquely positioned steel plate can additionally be inserted, the antiballistic property is achieved in this construction over the entire door leaf plane of the roller door by two door leaves arranged one behind the other, as a result of which the weak point at the interface between the individual slats can be eliminated. Due to an offset arrangement of the slats of the two door leaves relative to one another, one slat always covers the interface between two slats of the other door leaf However, this arrangement of two door leaves does lead to considerable drawbacks of the entire roller door system. On the one hand, the space requirement for the roller door increases, because two door leaves must be installed one behind the other instead of one door leaf. On the other hand, the total energy demand of the system increases as well, because two door leaves rather than only one door leaf must now be moved for an opening or closing operation. Thus, this document could not offer any suggestion for finding the solution according to the present invention.

In an advantageous variant of the present invention, the insert may be oriented in the door leaf element obliquely to the door leaf plane at an angle of 2° to 30°, preferably 5° to 15°. Considerable reinforcement of the door leaf element against sagging is achieved hereby, which is especially advantageous in the open position. In addition, the overlap of the inserts can thus be established in the door leaf plane with simple means.

Further, two defense strips may be arranged, which cover the gap between the inserts of adjacent door leaf elements on both sides in the close state of the roller door. The security of the roller door can be increased further due to defense strips being arranged on both sides, i.e., due to the defense strips being arranged such that they are located opposite each other over the gap between the inserts. As a result, a projectile or fragment can be prevented, on the one hand, from entering the gap due to the defense strip located on the outer side relative to the insert. At the same time, a fragment is prevented by the defense strip located on the inner side relative to the insert from proceeding, after passing through the gap, by the defense strip located on the inner side even if a fragment has passed through the defense strip located on the outer side.

Moreover, the bulletproof roller door can be operated at a speed of at least 0.5 m/sec and preferably 1.5 m/sec. Due to this high-speed property, the bulletproof door leaf can be used not only in security-critical areas, but also in industrial areas. It is frequently desirable in these areas that the door leaf be able to be opened and closed within a few seconds, because the processes taking place during the operation shall not be hindered. A rapid opening and closing operation is, moreover, relevant for security in dangerous situations. If there is a threat from the outside, the roller door must have been closed after only a few seconds in order to resist ballistic attacks.

In addition, a labyrinth-like (labyrinth) closure may be present between end faces of two adjacent door leaf elements facing one another in the roller door according to the present invention. The security of the door leaf can thus be increased at the interface between two adjacent door leaf elements. If projectiles impact, for example, at an angle $\alpha t$ which they can enter between two door leaf elements rather than at right angles to the door leaf plane, they are stopped by the labyrinth closure. Similarly to this, fragments or the like can be prevented from penetrating the door leaf, because these are also deflected by the labyrinth closure and are thus stopped from penetrating the door leaf plane.

According to another advantageous embodiment, the roller door according to the present invention may have bulletproofness according to DIN EN 1522: 1998 corresponding at least to class FB3. The DIN EN 1522 standard classifies the bulletproofness of windows, doors as well as closures. A desired protection can be achieved by complying with a certain class. The possible parameters for reaching the desired class are composed of, among other things, the material used as well as the thickness of the insert used in case of the insert. A roller door of class FB3 provides reliable protection against projectiles.

Further, the insert and/or the at least one defense strip may be inserted into the door leaf element by press fit. Additional holding and fastening elements are unnecessary for the insert due to the use of a press fit. Since no additional elements are to be provided, the weight of each door leaf element can be kept even lower. In addition, the insertion of the insert is kept so simple due to the press fit that no additional tools are necessary in case of changing the insert, for example, to a higher protection class.

In a variant of the present invention, the density of the material, preferably aluminum, of the door leaf material, may be lower than the density of the material, preferably steel, of the insert and/or of the at least one defense strip. The weight can be kept low through this combination of materials despite the antiballistic property of the door leaf. Since the entire door leaf plane is covered due to the overlap of the inserts with one another, it is sufficient for the insert to possess the antiballistic property. The rest of the door leaf element does not have to meet this requirement and may therefore be made as lightweight as possible, i.e., with a lower density. The material of the door leaf element may therefore be selected, for example, such that it possesses different properties, e.g. high corrosion resistance.

According to another aspect of the present invention, a door leaf element is provided for a bulletproof roller door. The door leaf element has a door leaf element body with a cavity in the cross section, into which an antiballistic insert is inserted, the insert having a plate-shaped configuration and being oriented obliquely in relation to the vertical orientation of door leaf element in the cavity of the door leaf element. The door leaf element is characterized in that at least one antiballistic defense strip oriented at an angle in relation to the insert is, furthermore, arranged in the cavity of the door leaf element.

Since the antiballistic property of the individual door leaf element is independent from the constructive configuration of the entire roller door, the door leaf elements may also be used to retrofit already existing roller doors. Such a door leaf element according to the present invention is a product that can be sold separately.

In addition, the advantages explained above on the basis of the roller door are equally achieved with the door leaf element according to the present invention.

Advantageous variants of the door leaf element according to the present invention provide effects already explained are equally achieved with the features being shown here.

The present invention will be explained in more detail below on the basis of the drawing figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
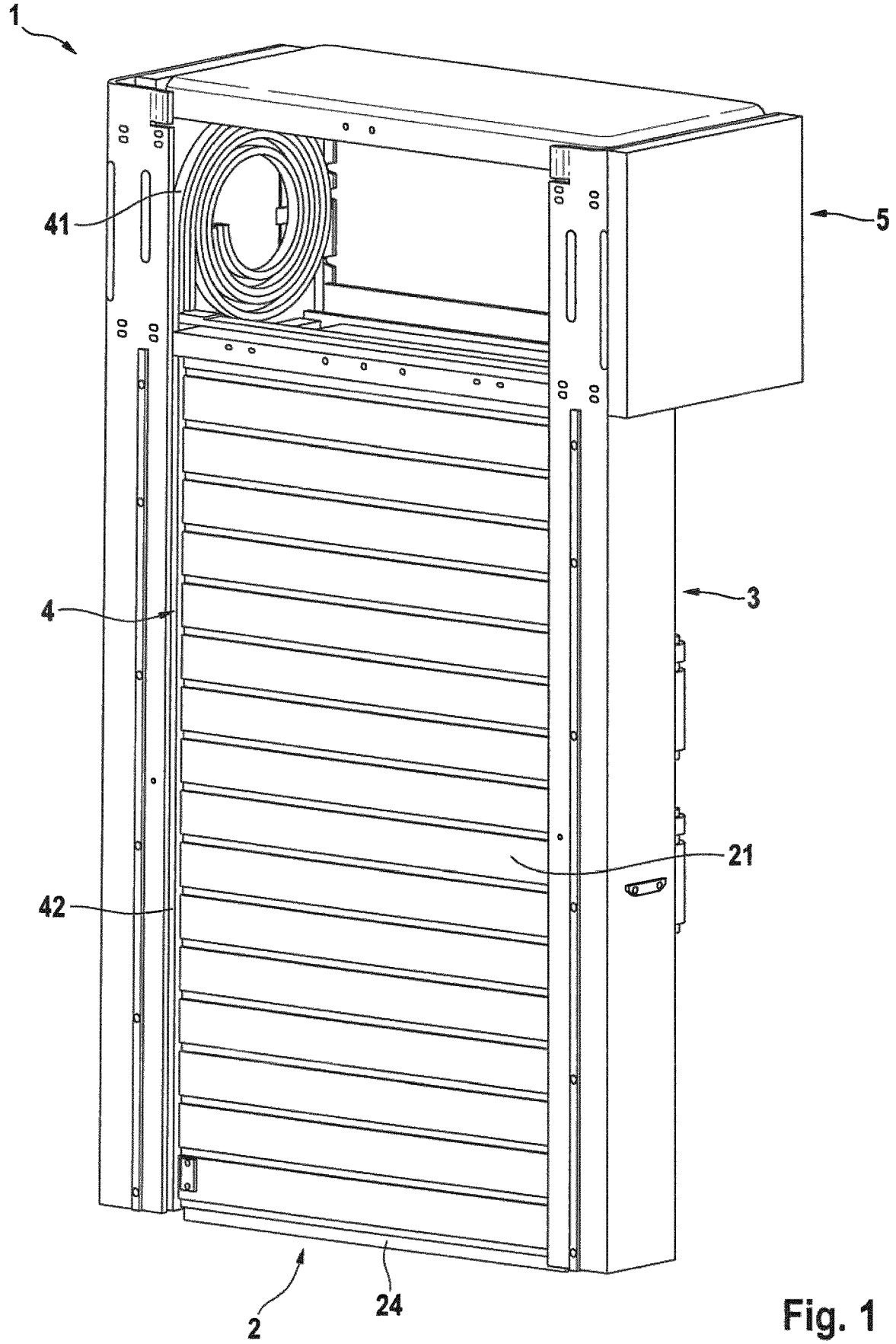
FIG. 1 is a perspective view of a roller door according to the present invention.

Referring to the drawings, FIG. 1 shows a perspective view of a roller door 1. The roller door 1 has a door leaf 2, which is guided vertically in guides 4 in the area of a door frame 3 on both sides. The door leaf 2 is driven by a drive 5 by means of a motor.

Each guide 4 has a spiral section 41 and a vertical section 42. In the open position, the door leaf 2 is accommodated as a roll in the spiral section 41 in the area of a door lintel, the layers of the roll being located without being in contact with one another. In the closed position, the door leaf 2 closes the free passage space, i.e., the area of the door opening, between the lateral guides 4 completely down to the bottom and forms the door leaf plane in this state.

Figure 2:
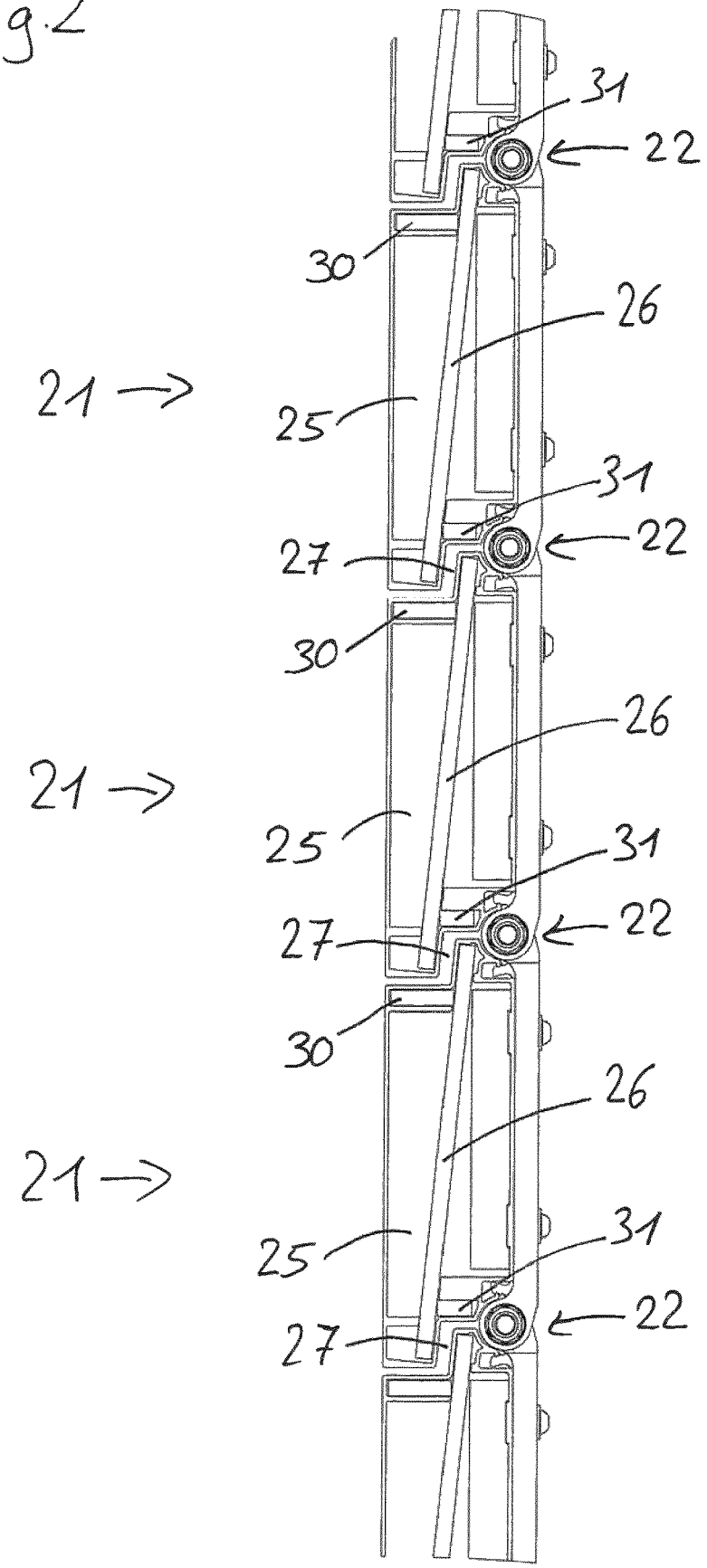
FIG. 2 is a lateral view of a detail of a door leaf with door leaf elements according to a first embodiment.

The door leaf 2 is built from slats (door leaf element bodies) 21 acting as door leaf elements, which are connected to one another articulatorily via lateral hinge straps 23 via hinges 22 in relation to one another according to FIG. 2. As a bottom-side closure of the door leaf 2, a closing shield 24, which lies on the bottom side with a leading edge formed thereon in the closed position, adjoins the lowermost slat 21 of the door leaf 2.

FIG. 2 shows a lateral detail of the door leaf 2 with slats 21. An antiballistic insert 26 is inserted obliquely into a cavity 25 of the slat 21. The insert 26 is configured as a steel plate with the density of a steel, equaling about 7.86 g/cm3, the steel plate having a thickness of 4 mm. The width and height of the steel plate depend on the dimensions of the door leaf. The width is about 3 m in the exemplary embodiment, the height of the insert 26 depending directly on the height of the slat 21 and equaling 15 cm here. The slat 21 leading in the closing direction is overlapped here by the slat 21 following it in the closing direction. A labyrinth overlap 27 is formed as a closure between the slats 21 due to this overlap of adjacent slats 21.

Figure 3:
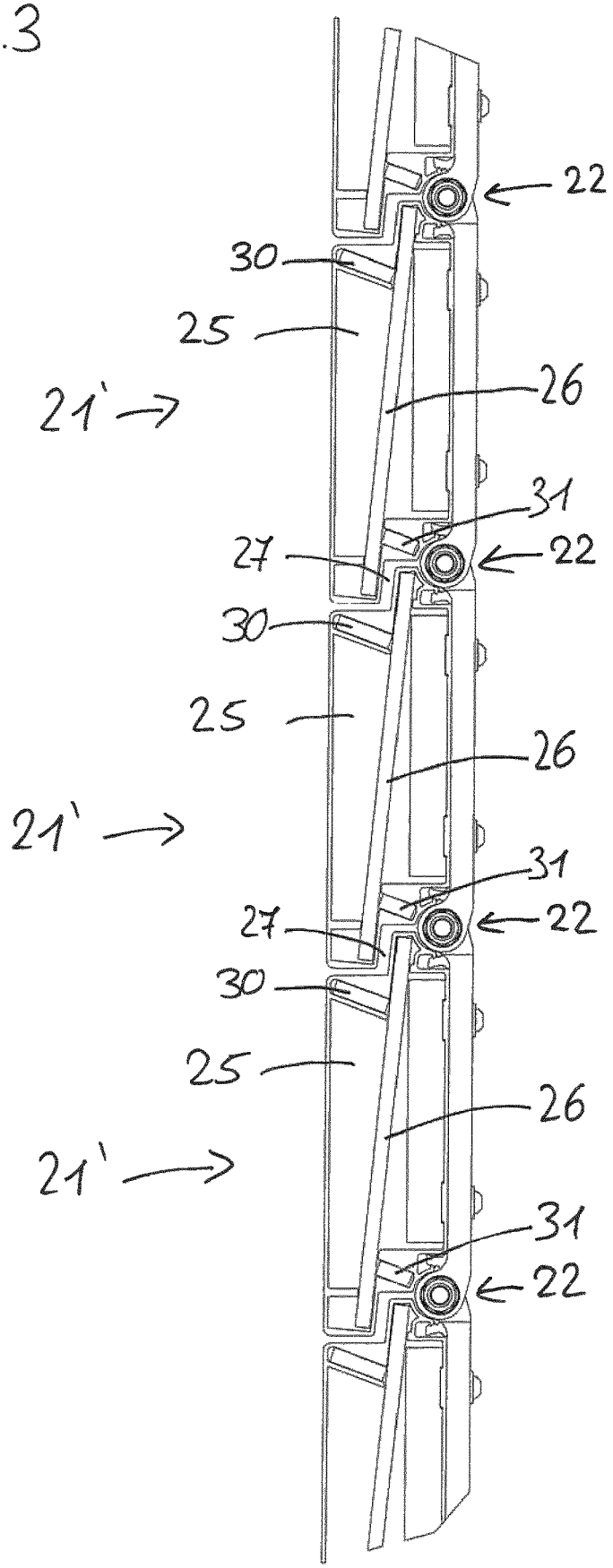
FIG. 3 is a lateral view of a detail of a door leaf with door leaf elements according to a second embodiment.
Figure 4:
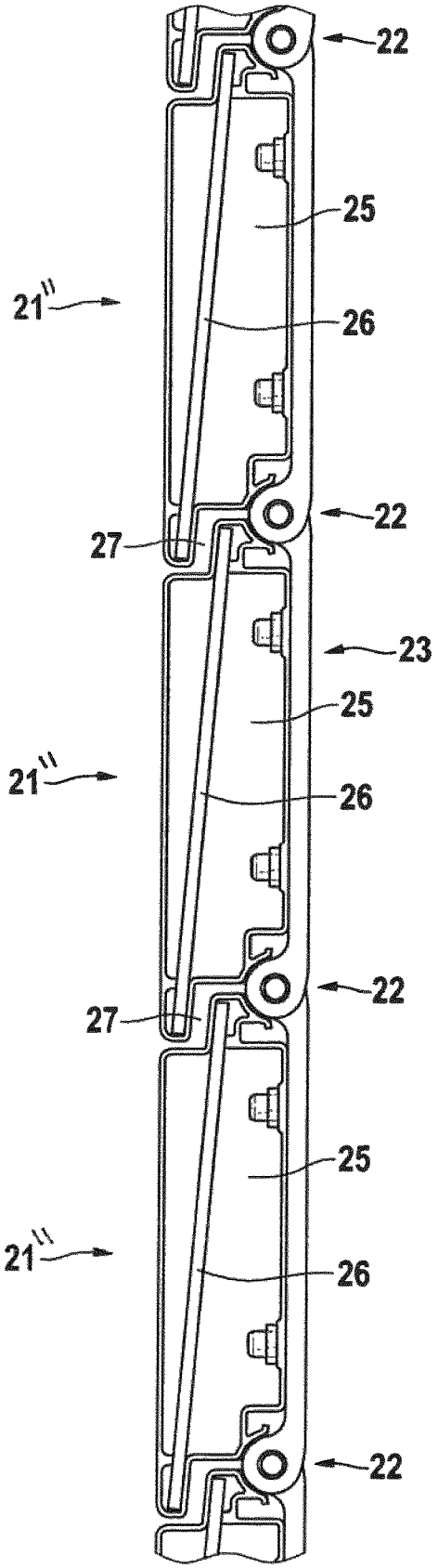
FIG. 4 is a lateral view of a detail of a door leaf with door leaf elements without defense strips.
Figure 5:
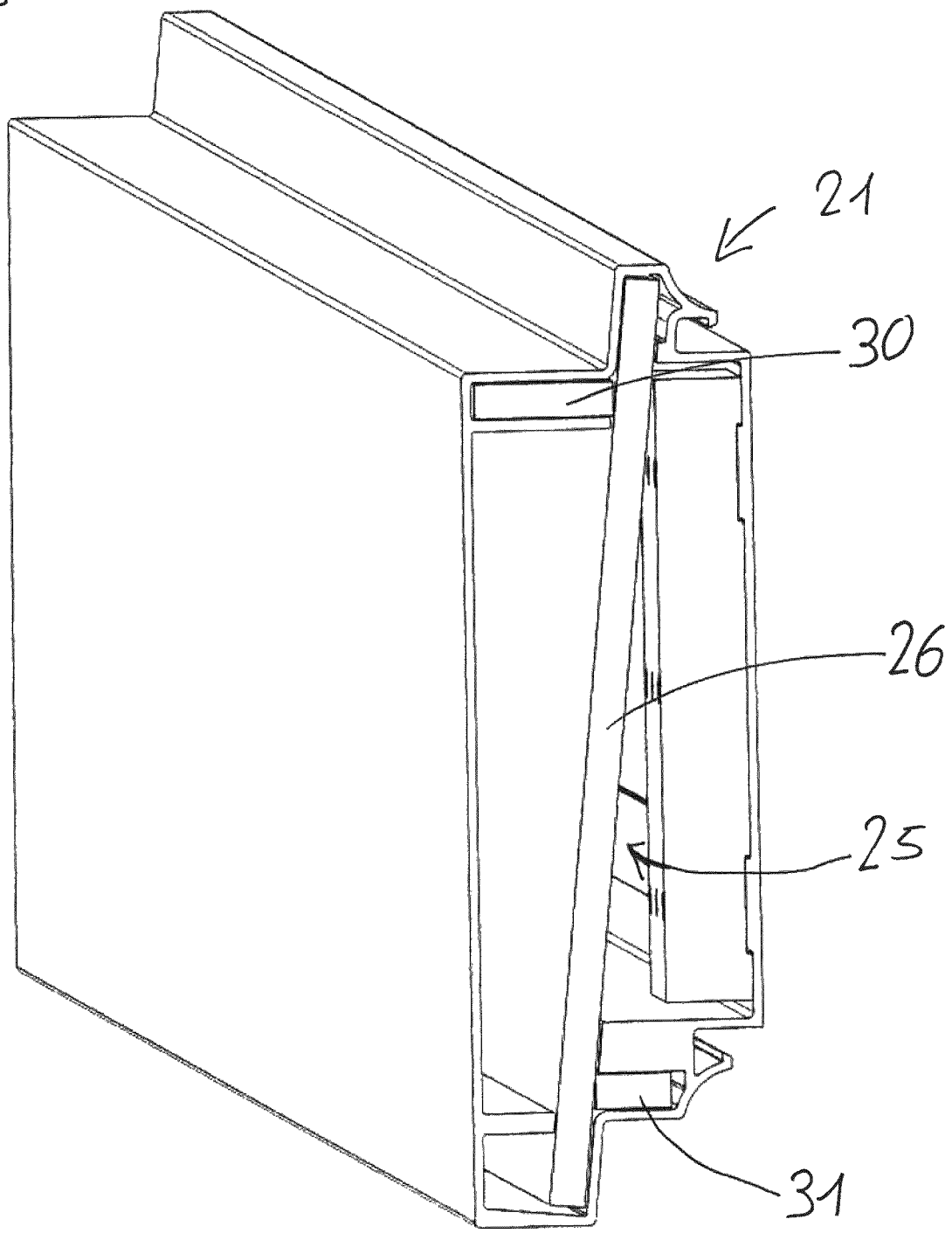
FIG. 5 is a perspective detail view of a door leaf element according to the present invention according to a first embodiment.
Figure 6:
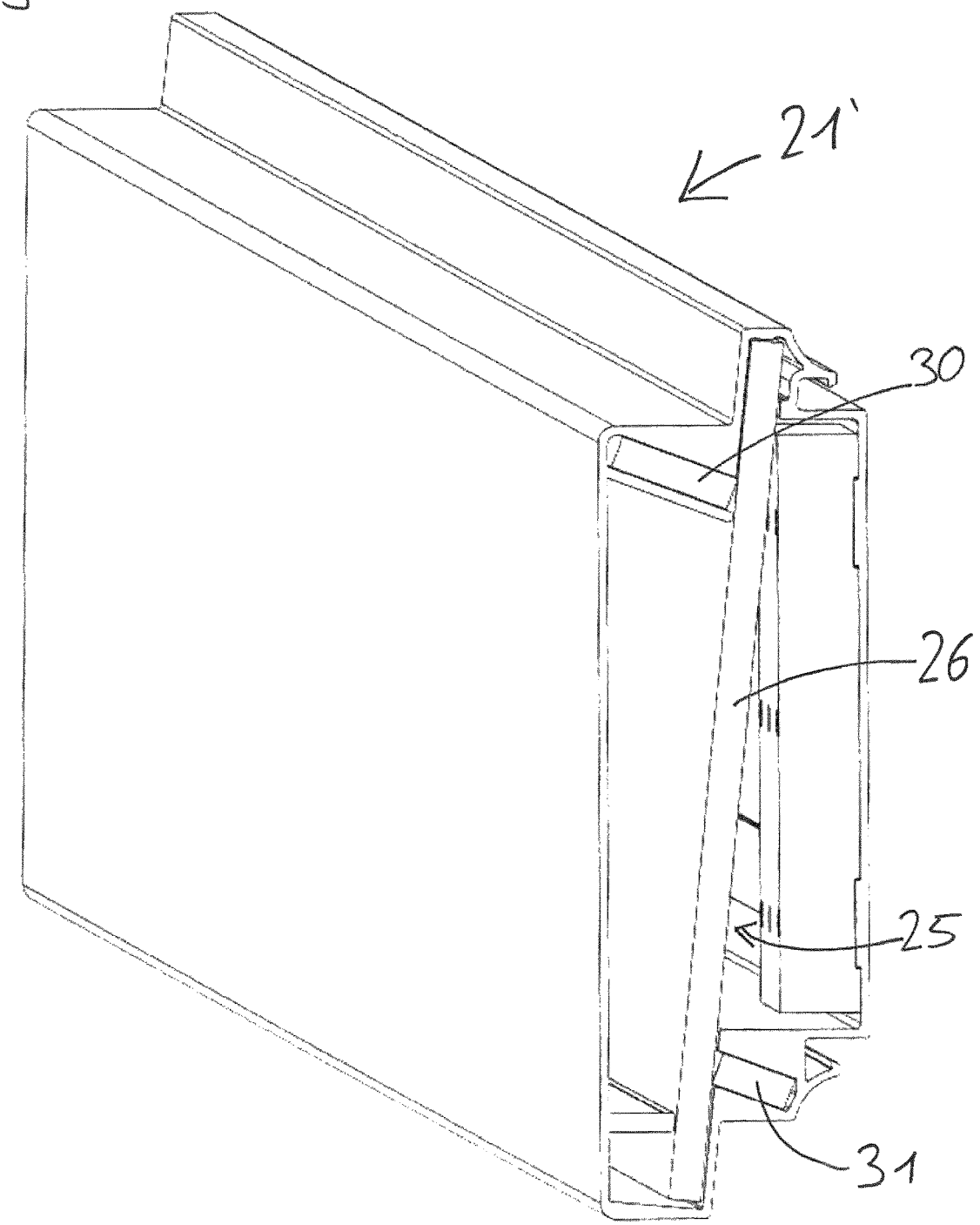
FIG. 6 is a perspective detail view of a door leaf element according to the present invention according to a second embodiment.

In addition, the arrangement of defense strips 30, 31 is shown in FIG. 2. As can be seen here, two defense strips 30, 31 are inserted into each cavity 25 of a slat 21. These defense strips are in contact with the insert 26 such that a first defense strip 31 extends starting from the insert 26 to an interior, while the defense strip 30 extends from the insert 26 to the outer area of the roller door 1. The defense strips 30, 31 thus extend bent at an angle in relation to the door leaf plane. The defense strips 30, 31 may extend, as is shown in FIG. 2, at right angles, at an angle of 90°, to the door leaf plane or, as is shown in FIG. 3, they may extend at an angle different from 90°, i.e., obliquely to the door leaf plane.

The gap formed between two respective inserts 26 in the overlapping area thereof is covered by two defense strips 30, 31, for example, such that there is no free space, through which a straight line can be drawn from the outside of the roller door 1 to the inside of the roller door 1, between the insert 26 and the defense strips 30, 31. Consequently, no direct penetration of a projectile or of a fragment through the roller door 1 is possible.

In addition, the antiballistic insert 26 has a one-piece configuration. A bulletproof property can thus be guaranteed with an even higher degree of certainty. No interfaces need to be bridged over or no fastening points need to be additionally secured at the insert 26 due to this configuration. Thus, not only can the security be increased due to the one-piece configuration, but the manufacturing process as well as the insertion of the insert 26 into the slat 21 also become simpler at the same time.

The individual defense strips 30, 31 also have a one-piece configuration. These have, e.g., a plate-shaped configuration and have a length corresponding to the width of the door leaf 2 or corresponding to the insert 26. The thickness of the respective defense strips 30, 31 may differ from one another and may differ from that of the insert 26. As an alternative, the insert 26 as well as the at least one defense strip 30, 31 may also be elements consisting of the same material as well as have the same thickness. The defense strips 30, 31 thus may be a steel plate with the density of a steel, equaling about 7.86 g/cm3. In addition, the defense strips 30, 31 may have, for example, a thickness of 4 mm. The defense strips 30, 31 possess antiballistic properties, similarly to the insert 26. The material of the insert 26 and of the defense strips 30, 31 may be, for example, hot-rolled steel.

Figure 7:
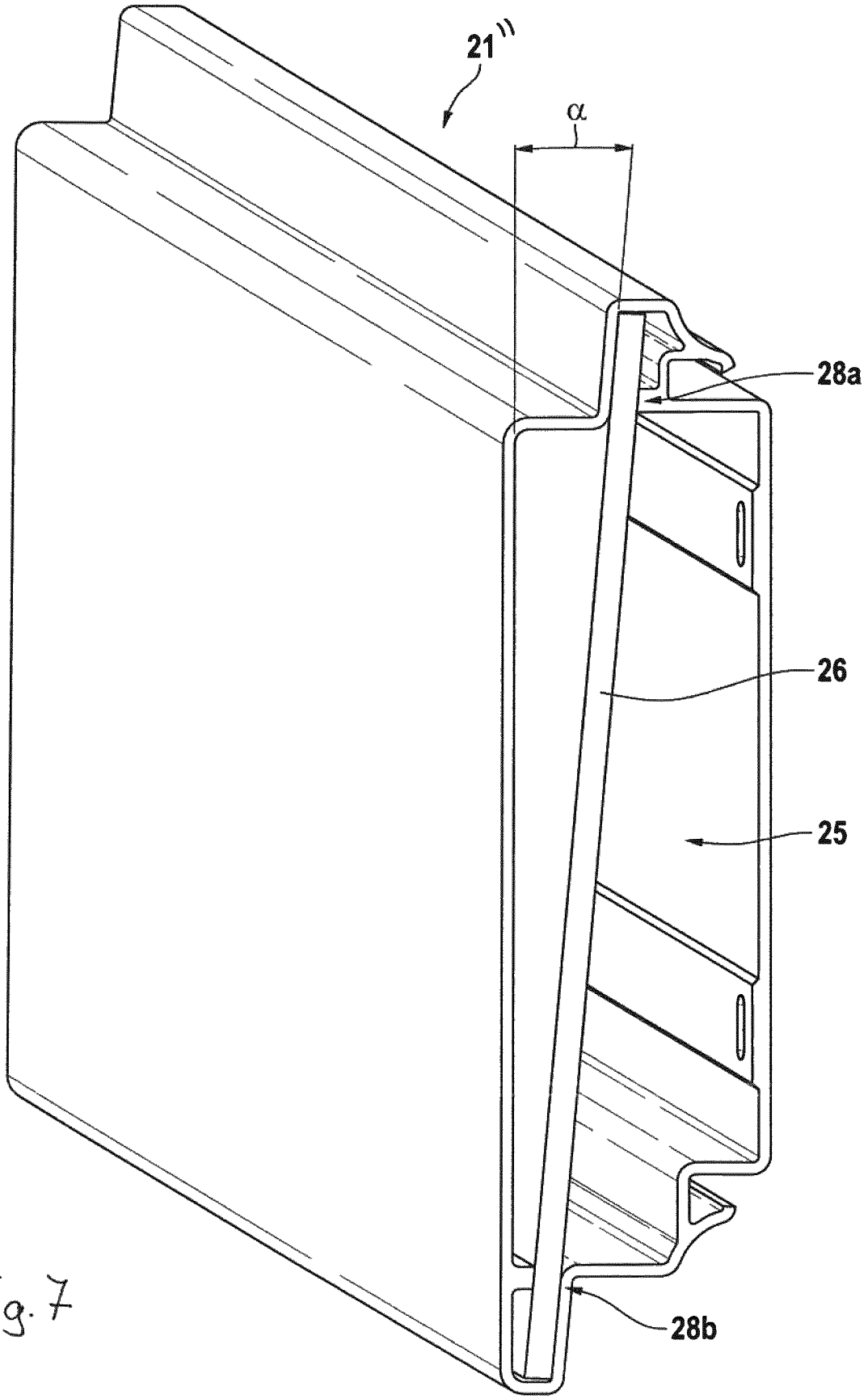
FIG. 7 is a perspective detail view of a door leaf element according to the present invention without insertion areas for a defense strip.

FIG. 7 shows a detail view of a slat 21" according to the present invention. The defense strips 30, 31 are not shown in this view for the sake of simplicity. The antiballistic insert 26 is inserted into the slat 21" from the side. The defense strips 30, 31 may similarly be inserted into the slat 21" from the side. The at least one defense strip 30, 31 may be inserted individually or together with the insert 26. For example, the insert 26 and the defense strip 30, 31 may be welded, bonded or connected in a similar manner prior to the insertion into the slat 21".

The insert 26 and the defense strip 30, 31 are made in one piece and are formed by means of shaping, e.g., bending, deep-drawing or pressing. Thus, no edges need to be formed between the insert 26 and the defense strips 30, 31, but they may have a soft transition. This can be made possible by a correspondingly flexible and bulletproof material of the insert 26 and of the defense strips 30, 31. For example, a metal with high flexibility and/or deformability may be used here. Depending on the particular application, the material of the insert 26 and of the defense strips 30, 31 may be varied. Replacement of, for example, only the at least one defense strip 30, 31 or of the insert 26 only is conceivable, while the insert 26 or the at least one defense strip 30, 31 remains in the cavity 25. Further, the insert 26 may be inserted by press fitting into the slat 21" at an upper point 28*a* and at a lower point 28*b*. A receiving pocket is formed for this in the slat 21" at an upper sixth in the closing direction and at a lower sixth in the closing direction. The insert 26 extends in the upper and lower receiving pockets essentially over the entire width of the slat 21", i.e., the slat 21" is fastened in the receiving pocket in an upper area and in a lower area over 3 m. In addition, the insert 26 extends vertically corresponding to the height of the slat 21", so that the insert 26 extends essentially between the points of the cavity 25 of the slat 21" that are the highest and lowest points in the closing direction. An angle $\alpha$, which equals 7° ($\alpha$=7°) in this exemplary embodiment, is formed between the insert 26 and the lateral walls of the slat 21", which are parallel to the door leaf plane.

Figure 8:
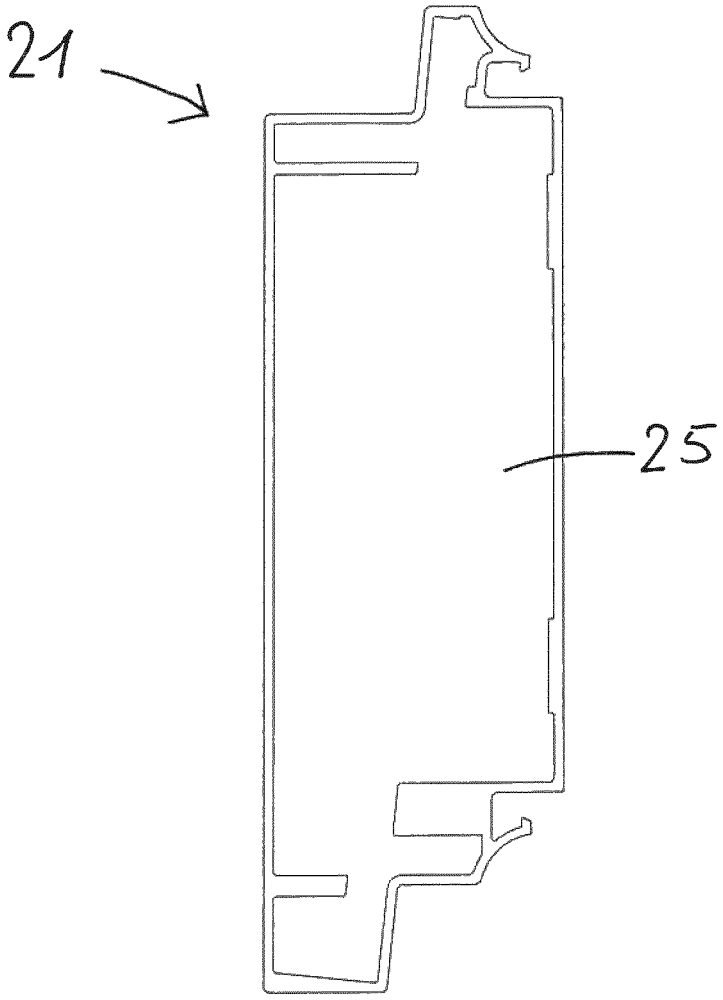
FIG. 8 is a view of a cavity of a door leaf element according to a first embodiment.
Figure 9:
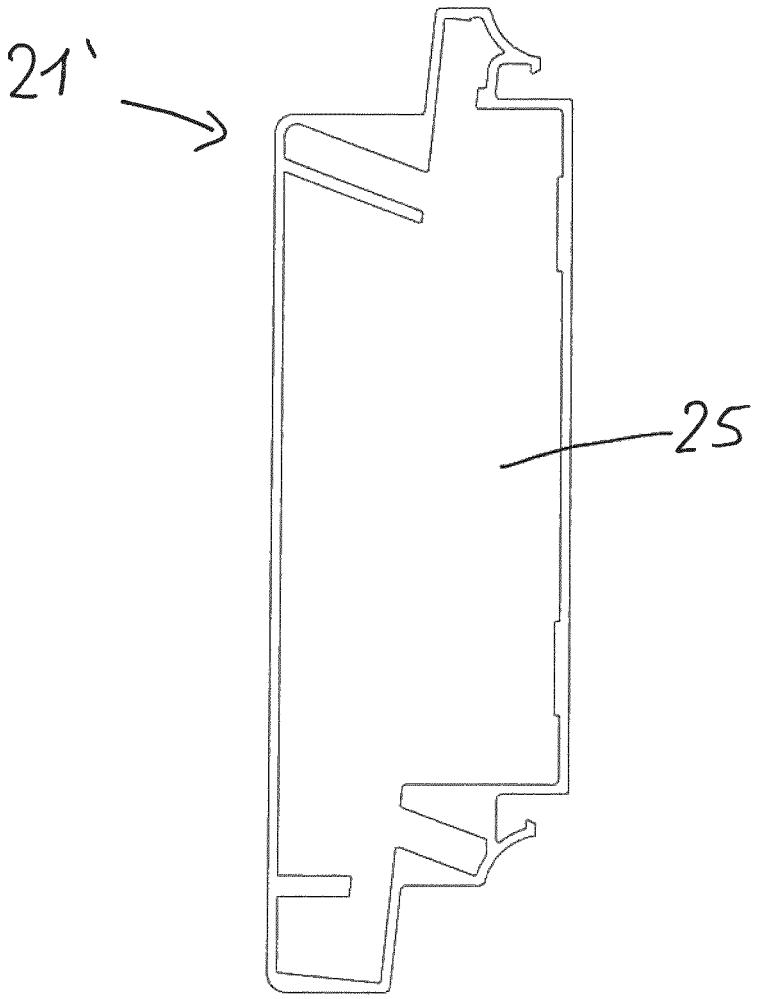
FIG. 9 is a view of a cavity of a door leaf element according to a second embodiment.

FIGS. 8 and 9 show examples of cavities 25 of a slat 21, 21'. As can be seen here, the slat 21, 21' has a contour in which respective insertion areas for an insert 26 or defense strip 30, 31 are formed. By forming these insertion areas, the insert 26 as well as the defense strips 30, 31 can be accommodated in the cavity 25 in the particular position with certainty, so that tilting, wobbling or slipping is prevented from occurring and the security of the roller door 1 thus remains guaranteed.

A projectile is to be expected to penetrate the outwardly directed first surface of the slat 21, 21', 21" in case of a ballistic attack from the outer side of the door leaf 2. After penetration through this surface, the projectile reaches the insert 26. Since this insert 26 possesses an antiballistic property, the projectile cannot penetrate this insert 26 and is deflected at this surface or it remains lodged in the insert 26.

Due to the simple construction of the slat 21, 21', 21", the damaged slat 21, 21', 21" can be detached from the lateral hinge straps 23, to which the slats 21, 21', 21" are screwed. A new slat 21, 21', 21" can then be inserted between two old slats 21, 21', 21".

The antiballistic insert 26 can likewise be replaced in all slats 21, 21', 21". Since the insert 26 has a plate-shaped configuration, it can be manufactured in a simple manner and must only be cut to the dimensions of the cavity 25 of the slat 21, 21', 21". Due to the inserts 26 being inserted into the slats 21, 21', 21" by press fit, these can be removed and new inserts 26 can be inserted rapidly. As a result, the entire door leaf 2 can have different properties and be adapted to changed surroundings.

If a projectile does not reach the door leaf 2 at right angles or if fragments are formed due to the impact of the projectile on the slat 21, 21', 21" or the insert 26, these can be prevented by the labyrinth-shaped overlap 27 or by the defense strips 30, 31 from moving farther to the inner side of the door leaf 2. It is thus ensured by the overlap 27 of the slats 21, 21', 21" that the door leaf 2 as a whole is bulletproof. In addition, deflected parts can be caught by the labyrinth overlap 27.

The present invention allows further principles of configuration in addition to the embodiment explained.

The angle $\alpha$between the slat 21, 21', 21" and the insert 26 may be varied between 2° and 30° and preferably between 5° and 15°. The reinforcement of the slat 21, 21', 21" and hence the stability thereof can be adapted depending on the angle. At the same time, the weight of the individual slat 21, 21', 21" changes depending on the angle $\alpha$s well. The angle is to be selected depending on the dimension of a slat 21, 21', 21", the material used, the width of the door leaf 2 and the desired bulletproof effect. In the case in which the door leaf 2 is deflected in a horizontal position into the opened state, a bending moment acts on the long sides of the slat 21, 21', 21". Due to the oblique arrangement of the insert 26, the moment of resistance of the entire slat arrangement can be increased relative to this bending moment. The moment of resistance of the slat arrangement now increases with the angle $\alpha$.

In addition, additional defense strips may be arranged in the cavity 25 of a slat 21 in order thus to further increase the protection of the roller door 1. It is also possible to arrange only one defense strip 30, 31 instead of a plurality of defense strips 30, 31 in the cavity 25. For example, only the defense strip 30 may thus be formed, which extends relatively outwards relative to the insert 26 and is arranged in an upper area of an insert 26. The defense strip 30 is arranged now such that the gap formed between the inserts 26 is covered by the defense strip 30 from below, i.e., in the direction of the opening direction of the roller door 1.

The additional defense strip 31, which is formed on the opposite side of the first defense strip 30 of the insert 26, i.e., extending inwards, may also be formed instead of or in addition to the defense strip 30. This defense strip 31 may be formed, for example, in a lower area of the insert 26. This defense strip 31 thus covers the gap between the inserts 26 when viewed from the top, i.e., in the direction of the closing direction.

In another embodiment, the defense strips 30, 31 may be set at right angles on the insert 26. The defense strips 30, 31 form an angle different from 90° with the door leaf plane in this case. In addition, the defense strips 30, 31 may have a cut edge, which is located in the installed state on the insert 26, which is formed obliquely to the plane of the plate of a defense strip 30, 31. The defense strips 30, 31 can thus be flatly flush with the insert 26, even if an angle different from 90° is formed between the insert 26 and the defense strip 30, 31, i.e., the defense strips 30, 31 are not at right angles to the insert 26.

The slats 21, 21', 21" according to the present invention have a stepped configuration, with at least one step, at the leading end in the closing direction. The surfaces of the slats 21, 21', 21", which are the front surfaces in the closing direction, preferably extend rising in a stepped manner from the inner side to the outer side in the closing direction. It is also conceivable, however, that these surfaces of the slats 21, 21', 21" extend descending from the inner side to the outer side in the closing direction. A step is formed by two essentially mutually parallel surfaces, which are connected by a surface extending essentially at right angles to these. The slat 21, 21, 21" may also be formed with a plurality of steps at the end that is the leading end in the closing direction. If two slats 21, 21', 21" are oriented adjacent to one another, the surface of the slats 21, 21', 21" that are the leading slats in the closing direction extends along the negative step profile of the opposite surface of the slat 21, 21', 21" that is the following slat in the closing direction. The stepped configuration may, however, also be abandoned.

It is conceivable, furthermore, that the slats 21, 21', 21" do not overlap in an area of the hinges 22 but at a spaced location herefrom. The surface of the overlap, i.e., the length of the area extending in the closing direction, in which area a slat is located above the other slat in the door leaf plane, is also freely selectable and may be between a few mm and several cm.

In a preferred embodiment, the roller door 1 is configured as a high-speed roller door 1, which can be operated at speeds above 0.5 m/sec and preferably 1.5 m/sec. As an alternative, the roller door 1 may also be configured as a slow-moving roller door 1, which can be moved at speeds below 0.5 m/sec. The speed of motion that can be reached may, however, also be greater than 1.5 m/sec and reach about 2.5 m/sec or higher in case of roller doors 1 of small dimensions. In addition, the roller door 1 may be configured such that it closes with a higher speed in a dangerous situation compared to the operating speed reached in the normal case. For example, the closing speed is frequently set at a lower value for security reasons than the speed of the roller door 1 during an opening operation. If, however, a dangerous situation is detected, e.g., by means of sensors, the roller door 1 may also reach the opening speed or an even higher speed, utilizing the force of gravity of the roller door 1.

As an alternative to labyrinth closures between the individual slats 21, 21', 21", which are formed by one or more steps, additional contactless closures are possible. For example, the closures between the slats 21, 21', 21" may be configured as shapes with an acute angle of 110°. Half-round cross-sectional shapes, which are formed as a projecting dome-like shape (dome shape) on one surface of each slat and correspondingly form a half-round recess on the opposite surface of the adjacent slat, are also possible at the mutually opposite ends of the slats 21, 21', 21".

To establish an antiballistic property of the roller door 1, the insert 26 as well as the at least one defense strip 30, 31 possess antiballistic properties. The insert 26 as well as the at least one defense strip 30, 31 may also comply with all other classes of DIN EN 1522: 1998, for example, class FB2 or FB4, in addition to class FB3. In addition to the insert 26, the slat 21, 21', 21" may, however, also possess antiballistic properties itself, for example, when this is made of a steel. Therefore, the antiballistic properties of the slat 21, 21', 21" itself and of the insert 26 arranged herein may complement each other. To achieve a bulletproof property of the roller door 1 according to FB3, it may consequently suffice if the insert meets a bulletproofness according to FB2 if the slat 21, 21', 21" has such an antiballistic property, in addition to the insert 26, that the roller door 1 as a whole complies with a bulletproofness according to FB3.

Due to the insert 26 as well as the at least one defense strip 30, 31, the roller door 1 can be tested corresponding to DIN EN 1523: 1998 for different types of projectiles in order to reach a certain class according to DIN EN 1522: 1998, e.g., class FB3, or a higher class. In particular, different bullet angles and impact points are tested at different distances. The bulletproofness is also tested in this connection with respect to the overlapping areas at different angles of impacting projectiles.

The inserts 26 may be fastened by means of a press fit in the receiving pockets in the slats 21, 21', 21". To make possible an easier replacement of the inserts 26, the inserts 26 may, however, also be arranged with a clearance fit in the slats 21, 21', 21". Other holding systems are also possible for the insert 26 in the slat 21, 21', 21". Thus, the inserts 26 may be fastened with screws or rivets in the slat 21, 21', 21". If replacement of the inserts 26 is not intended, the inserts 26 may also be fastened by means of nondetachable connections in the slats 21, 21', 21". Forming under compressive conditions at different points of the slat 21, 21', 21", bonding or welding of the insert 26 into the slat 21, 21', 21" is conceivable here.

In one embodiment of the present invention, the slat 21, 21', 21" may be manufactured from aluminum. The slat 21, 21', 21" may, however, also be manufactured from any other, preferably corrosion-resistant and lightweight material. The slats 21, 21', 21" extend from one lateral guide 4 to the other lateral guide 4, so that they cover the entire width of the door leaf 2 or of the door opening. In one embodiment, the slat 21, 21', 21" is manufactured from different materials. The side of the slat 21, 21', 21" pointing towards the outer side of the door leaf 2 is manufactured from a corrosion-resistant material, for example, stainless steel, while the side of the slat 21, 21', 21" pointing towards the inner side of the door leaf 2 is manufactured from a lightweight material, for example, aluminum.

Examples of materials of the antiballistic insert 26 are security steels, such as the material SECURE 500®, or composites, such as carbon fiber-reinforced plastics, Kevlar or CFK, for example, the material Duroprotect 5000®. The material of the insert 26 may, however, also be any other material possessing antiballistic property. In addition, the materials of the inserts 26 do not need to consist of the same material. For example, the inserts 26 in the middle area of the door leaf 2 may consist of a material of a higher bulletproofness class according to DIN EN 1522 and inserts 26 in the lower and upper areas of the door leaf 2 may belong to a lower class.

Moreover, inserts 26 do not need to be inserted in all slats 21, 21', 21". For example, inserts 26 may only be inserted into the lower slats 21, 21', 21" leading in the closing direction, while the upper slats 21, 21', 21" are configured without inserts 26.

Further, the insert 26 as a whole does not have to be manufactured from the same material. For example, the insert 26 may be configured as a multilayer insert consisting of different materials connected to one another, or they may be divided into different areas and consist of a different material depending on the area and possess other physical properties. For example, the roller door 1 may be installed in an area in which ballistic attacks are only possible from one direction. Accordingly, the material in the middle area of the insert 26 could possess physical properties that are especially resistant to loads acting at right angles, whereas the lateral areas of the insert 26 are manufactured from a material that is especially resistant to loads acting obliquely in relation to the surface.

A rubber profile may additionally be provided in the labyrinth overlap 27 between adjacent slats 21, 21', 21" in order to also configure the overlap 27 as an overlap sealed in respect to moisture and temperatures.

To guarantee a comprehensive protective effect of the bulletproof roller door 1, a door frame 3 around the door leaf 2 may be made likewise of an antiballistic material, for example, steel.

The door shown in FIG. 1 is configured as a roller door 1. However, the door leaf elements according to the present invention can equally be used in other door arrangements and other orientations of the door leaf plane as well as in door arrangements. As an alternative, the door leaf elements may also be integrated individually into already existing door leaf arrangements or be replaced with existing elements.

While specific embodiments of the invention have been shown and described in detail to illustrate the application of the principles of the invention, it will be understood that the invention may be embodied otherwise without departing from such principles.

The invention claimed is:

1. A bullet-resistant roller door with a door leaf comprising:

hinges;

door leaf elements connected articulatorily to one another via the hinges, which door leaf defines a door leaf plane in a closed state of the roller door, wherein the door leaf can be moved to and fro between an open position and a closed position by means of a drive, wherein the door leaf elements define cavities in an interior thereof;

an antiballistic insert inserted in each of the cavities such that each of the inserts of adjacent door leaf elements overlap in the door leaf plane in the closed state of the roller door, so that the door leaf possesses antiballistic properties over an entirety of the door leaf plane in the closed state of the roller door, wherein the insert comprises a flat plate configuration, wherein the insert is oriented obliquely to the door leaf plane within the cavity of the door leaf element, and wherein in the closed state of the roller door the door leaf elements overlap each other in a step-shape in the area of the hinges, forming a gap between inserts of adjacent door leaf elements; and at least one antiballistic defense strip positioned in the cavity at an angle in relation to the insert to cover the gap between the inserts of adjacent door leaf elements in the closed state of the roller door, wherein the at least one antiballistic defense strip comprises two antiballistic defense strips positioned in the cavity at an angle in relation to the insert to cover, with one of the two antiballistic defense strips arranged on one side of the antiballistic insert and another one of the two antiballistic defense strips arranged on another side of the antiballistic insert to form a labyrinth shaped closure between two adjacent door leaf elements.

2. A bullet-resistant roller door in accordance with claim 1, wherein the insert is oriented at an angle of 2° to 30° obliquely to the door leaf plane.

3. A bullet-resistant roller door in accordance with claim 1, wherein the roller door can be operated at a velocity of at least 0.5 msec.

4. A bullet-resistant roller door in accordance with claim 1, wherein the roller door complies with a bulletproofness class of at least FB3 according to DIN EN 1522: 1998.

5. A bullet-resistant roller door in accordance with claim 1, wherein the insert and/or the at least one defense strip are inserted by press fit into the door leaf element.

6. A bullet-resistant roller door in accordance with claim 1, wherein a density of material of the door leaf element is lower than a density of material of the insert.

7. A door leaf element for a bullet-resistant roller door, the leaf element comprising:

door leaf element body defining a cavity in an interior thereof;

an antiballistic insert having a flat plate configuration, wherein the insert is oriented obliquely in relation to the vertical orientation of the door leaf element and in a closed state of the bullet-resistant roller door the door leaf element overlaps an adjacent door leaf element in a step-shape in an area of a hinge to which the door leaf element body is connected forming a gap between inserts of adjacent door leaf elements; and two antiballistic defense strips positioned in the cavity at an angle in relation to the insert to cover the gap, with one of the two antiballistic defense strips arranged on one side of the antiballistic insert and another one of the two antiballistic defense strips arranged on another side of the antiballistic insert to form a labyrinth shaped closure between two adjacent door leaf elements.

8. A door leaf element in accordance with claim 7, wherein characterized in that the insert is oriented at an angle of 2° to 30° , obliquely to the vertical orientation of the door leaf element.

9. A door leaf element in accordance with claim 7, wherein the door leaf element complies with a bulletproofness class of at least FB3 according to DIN EN 1522: 1998.

10. A door leaf element in accordance with claim 7, wherein the insert and/or the at least one defense strip are inserted by press fit into the door leaf element.

11. A door leaf element in accordance with claim 7, wherein a density of material, of the door leaf element is lower than a density of the insert.

12. A door leaf element in accordance with claim 11, wherein the material of the door leaf element comprises aluminum.

13. A door leaf element in accordance with claim 11, in combination with a hinge strap with hinge portions configured to cooperate with hinge portions of an adjacent hinge straps to form the hinges, wherein the door leaf is connected to the a hinge strap for articulated movement therewith.

14. A bullet-resistant roller door with a door leaf comprising:

hinge straps with hinge portions each configured to cooperate with one of the hinge portions of one of the adjacent hinge straps to form hinges;

door leaf elements, each of the door leaf elements being connected to a respective one of the hinge straps to articulatorily connect door leaf elements to one another via the hinges, the door leafs having outer planer surfaces cooperating to define a door leaf plane in a closed state of the roller door, wherein each door leaf is configured to be moved to and fro between an open position and a closed position by means of a drive, wherein the door leaf elements define cavities in an interior thereof;

an antiballistic insert element inserted in each of the cavities such that each of the antiballistic insert elements of adjacent door leaf elements overlap in the door leaf plane in the closed state of the roller door, so that the door leaf possesses antiballistic properties over an entirety of the door leaf plane in the closed state of the roller door, wherein the antiballistic insert element has a plate-shaped configuration with opposed parallel planer surfaces, wherein the antiballistic insert element is oriented obliquely to the door leaf plane within the cavity of the door leaf element, and wherein in the closed state of the roller door the door leaf elements overlap each other in a step-shape in the area of the hinges and with each antiballistic insert element forming a first gap between the antiballistic insert elements of adjacent door leaf elements at a first insert side of the respective antiballistic insert element and a second gap between antiballistic insert elements of adjacent door leaf elements at a second insert side of the respective antiballistic insert element; and a first antiballistic defense strip positioned in the cavity at an angle in relation to the antiballistic insert element and extending at one side in relation to the antiballistic insert element to cover the first gap between the inserts of adjacent door leaf elements in the closed state of the roller door;

a second antiballistic defense strip positioned in the cavity at an angle in relation to the antiballistic insert element and extending at another side in relation to the antiballistic insert element to cover the second gap between the antiballistic insert elements of adjacent door leaf elements in the closed state of the roller door, wherein the antiballistic insert element, the first antiballistic defense strip, extending at the one side and the second antiballistic defense strip, extending at the other side form a labyrinth shaped closure between two adjacent door leaf elements.

* * * * *